United States Patent [19]

Beyer et al.

[11] 4,153,477

[45] May 8, 1979

[54] FRICTION STRESSED MACHINE PARTS OF CAST IRON WITH LEDEBURITIC BEARING SURFACE AND METHODS FOR THEIR PRODUCTION

[75] Inventors: Horst Beyer, Burscheid; Hans J. Neuhäuser, Berg.-Gladbach, Paffrath; Hans-Jürgen Veutgen, Burscheid, all of Fed. Rep. of Germany

[73] Assignee: Goetzewerke Friedrich Goetze AG, Burscheid, Fed. Rep. of Germany

[21] Appl. No.: 791,890

[22] Filed: Apr. 28, 1977

[30] Foreign Application Priority Data

Apr. 29, 1976 [DE] Fed. Rep. of Germany ..... 2618775

[51] Int. Cl.[2] ..... C21D 5/00; C22C 37/04

[52] U.S. Cl. ..... 148/1; 148/3; 148/4; 148/35; 148/39; 148/138; 148/139; 164/127; 277/81 P; 277/236; 418/178; 418/179

[58] Field of Search ..... 148/35, 138, 4, 1, 3, 148/39, 139; 164/127; 277/81 P, 236; 418/178, 179

[56] References Cited

U.S. PATENT DOCUMENTS

| | | | |
|---|---|---|---|
| 3,802,927 | 4/1974 | Gomada | 148/4 |
| 3,998,664 | 12/1976 | Rote | 148/138 |

*Primary Examiner*—R. Dean

*Attorney, Agent, or Firm*—Spencer & Kaye

[57] ABSTRACT

A friction stressed machine part of cast iron with a ledeburitic-containing bearing surface contains 0.1 to 10 area percent of predominantly nodular-shaped graphite in the ledeburitic-containing bearing surface. A number of methods for producing such a machine part are provided, including, casting the machine part against a quenching plate so that it hardens in a mottled manner in the region of the bearing surface.

14 Claims, 3 Drawing Figures

FRICTION STRESSED MACHINE PARTS OF CAST IRON WITH LEDEBURITIC BEARING SURFACE AND METHODS FOR THEIR PRODUCTION

BACKGROUND OF THE INVENTION

The present invention relates to friction stressed machine parts of cast iron with a ledeburitic bearing crest, such as sealing strips for rotary engines with a ledeburitic bearing crest, and methods for producing them.

In the past, cast iron machine parts which are stressed by sliding friction have been hardened in the region of their bearing surfaces in order to increase their wear resistance. For sealing strips for rotary engines this is done, inter alia, by remelting the bearing crest, either by inductive heating (German Gebrauchsmuster No. 1,898,216), or through the influence of high energy electron beams (German Auslegeschrift No. 2,045,125), and subsequently quenching to produce ledeburitic cast iron with high carbide contents and correspondingly great hardness in the remelted zones. These remelted and quenched zones are comprised substantially entirely of ledeburitic cast iron.

However, with sealing strips for rotary engines, the hardness of the material of the bearing surfaces is not the only factor which is responsible for good wear resistance. The combustion chamber of a rotary engine contains chamber walls which have a trochoidal shape and the sealing strips which are disposed at the corners of the rotary engine rotor contact the trochoidal chamber walls and follow a trochoidal path to seal the combustion chamber. The sealing strips which are disposed at the corner of the rotary engine rotor are known as apex seals, and the portion of a sealing strip which contacts the trochoidal chamber wall is known as the bearing crest or surface. In order for there to be good wear resistance, there must be a good compatibility between the bearing crest of the sealing strip and the bearing surface of the trochoidal chamber wall which is contacted by the sealing strip, and there must be no formation of knocking marks, grooves or burn traces on either the bearing surface of the sealing strip or the bearing surface of the trochoidal chamber wall. However, the known sealing strips, be they made entirely of a ledeburitic solid hard casting, or be they made of gray cast iron having a ledeburitic bearing surface or crest made according to the above-described remelting process, do not always exhibit quite the desired compatibility. The bearing surface of the known sealing strips is very hard and grooves and burn traces form again and again in the trochoidal chamber wall in the path followed by the sealing strips and sometimes this results in malfunction of the entire system of sealing strip and trochoid.

In the ledeburitic bearing crests produced according to the above-described remelting process, the carbon is almost exclusively present as a carbide, lubricating graphite is almost completely absent, and compatibility between the bearing crest of the sealing strip and the bearing surface of the trochoidal chamber wall in the running path followed by the sealing strip is thus reduced during emergency operation (operation during dry run) as well as in normal operation.

SUMMARY OF THE INVENTION

An object of the present invention is to provide an improved friction stressed cast iron machine part which has a ledeburitic bearing surface.

A further object of the present invention is to provide a sealing strip with a ledeburitic bearing crest which has an improved compatibility with the trochoidal bearing surface of the chamber wall of the combustion chamber of a rotary engine.

Another object of the present invention is to provide methods for producing such improved friction stressed cast iron machine parts.

To achieve the foregoing objects and in accordance with its purpose, according to the present invention, care is taken that elemental or free graphite is also deposited in the zones of the ledeburitic bearing surface of the machine part.

Thus, the present invention provides a friction stressed machine part of cast iron with a ledeburitic-containing bearing surface, wherein 0.1 to 10 area percent of predominantly nodular-shaped graphite is present in the ledeburitic-containing bearing surface.

The cast iron machine parts of the present invention are produced in accordance with the present invention in that the known processes to produce ledeburitic cast iron zones are controlled so that free graphite is additionally produced in the structure. According to one known process for producing a cast iron machine part containing ledeburitic zones, the ledeburitic zones are produced in cast iron by casting the workpiece against quenching plates. According to another known process, the respective zones which are to be ledeburitic are melted, for example, with an electric arc, inductive heating, electron beams, plasma beams or laser beams, and then quenched. Each of these two known methods for producing ledeburitic zones can be used in the present invention with modification so that free graphite is formed. According to the present invention, the quenching speed of the molten cast iron in these known two processes is slowed down to such an extent that the cast iron hardens in a mottled manner in the desired regions, that is, a mixture of ledeburite and eutectic zones is formed in the structure with separation and formation of graphite.

Preferably the molted cast iron has a temperture of about 1500° to 1150° C. and is quenched to temperatures of about 700° C. within 10 – 15 seconds. The ledeburitic zones which are formed are iron carbide and they have a mass of 40 – 70 volume percent. The remaining eutectic zones contain lamellar graphite of ASTM type D.

The present invention can also be practiced, however, with a cast-iron workpiece which already has been provided with a hardened ledeburitic bearing crest by subjecting such a workpiece to a known tempering treatment by heating it, such as for several hours to more than 700° C., then giving it an accelerated cooling to below 500° C., and subsequently reheating to a temperature up to 700° C. Examinations of the resulting structures show that finely-dispersed free carbon is now present predominantly in the form of little nodules in the ledeburitic-containing bearing surface or crest. The workpieces which can be tempered in accordance with the present invention can have been ledeburitically hardened either by casting against a quench plate or by remelting the bearing surface of a cast workpiece followed by quenching. Preferably, the tempering treatment can be performed by heating the workpiece for 15 minutes to two hours to a temperature of 700° C., to 1025° C. thereafter quenching it to 400° to 500° C., and then reheating it for 30 minutes to two hours to a temperature of 300° to 700° C.

Suitable types of cast iron for the above applications are, in particular, gray cast iron types with lamellar (flake) graphite. These may be unalloyed, or, as the case may be, they may also be alloyed, particularly with the known carbide-forming elements so that the particular cast iron becomes even more wear resistant by the incorporation of special carbides. In other cases, however, cast iron with spherical graphite can also be used.

The preferably used alloying elements with carbide-forming properties are the following elements with their maximum added amounts: boron with 0,2%, zirconium with 0,3%, molybdenum with 0,5%, tungsten with 0,8%, vanadium with 1,0%, niobium with 0,5% and tantalum with 0,3%. These alloying elements may be added in single form or as mixture of two or more elements. In this second case the total amount of carbide-forming elements is not allowed to exceed 3%.

If required, the elements boron, zirconium, bismuth, tellurium, the lanthanides, magnesium, strontium, tin, antimony, aluminum and/or lead in alloyed, bound and/or mixed form can also be sprinkled in powdered form onto the sealing strip bearing crest before melting. The melting process causes these substances to dissolve in the molten iron and, during cooling, alloys with increased wear resistance are produced in these zones to simultaneously enhance the formation of tempered carbon.

Preferably 1 – 5 g of the powdered elements are sprinkled out to the sealing strip bearing crest so that about 1 $cm^2$ is covered with 0,1 to 0,5 g of powder.

Sealing strips produced in accordance with the present invention have been tested in commercially-available rotary engines against trochoidal bearing surfaces made of chromium or nickel dispersion layers. Compared to the known sealing strips with ledeburitic bearing crests, the novel sealing strips of the present invention exhibited better compatibility, particularly with respect to the starting and dry run behavior and, at the same time, the formation of burn traces and grooves in the trochoidal path was reduced.

While the processes as modified by the present invention are employed particularly to improve ledeburitic sealing strips, it is likewise within the scope of the invention to use these processes quite generally to improve the bearing surfaces of machine parts which are subject to friction. In particular, the bearing surfaces of oil sealing rings in rotary engines, piston rings and valve seat rings of reciprocating engines can be improved in accordance with the present invention.

BRIEF DESCRIPTION OF THE DRAWINGS

The accompanying drawings illustrate a presently preferred embodiment of the invention and, together with the description, serve to explain the principles of the invention.

Of the drawings.

DESCRIPTION OF A PREFERRED EMBODIMENT

EXAMPLE

Figure 1:
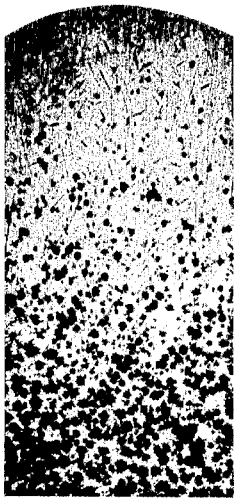
FIG. 1 is a cross-sectional view of a normal sealing strip with ledeburitic bearing crest, in 10-fold enlargement.
Figure 2:
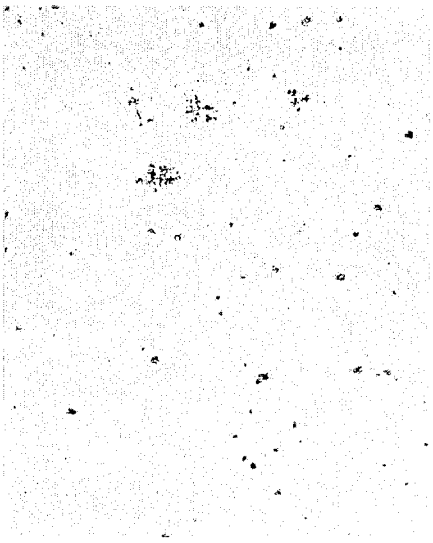
FIG. 2 is a grinding image from the region of the bearing crest before tempering, in 100-fold enlargement.

A blank sealing strip of a weakly alloyed gray cast iron with lamellar graphite and the dimensions 6.5 × 12 × 70 mm is melted by means of an electric arc in the region of the bearing crest to a depth of 2.5 mm and then quenched. FIG. 1 shows this sealing strip in cross-section and it can be seen clearly that the region of the bearing crest has ledeburitically hardened almost without graphite separation, while the lower not-remelted region has a gray cast structure with nests of lamellar graphite. FIG. 2 shows a grinding image from the region of the bearing crest with a very low proportion of graphite.

Figure 3:
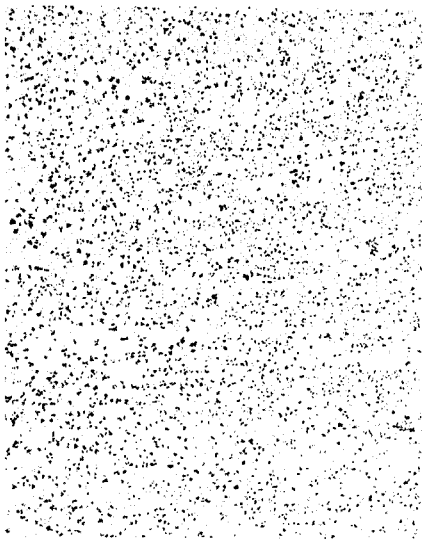
FIG. 3 is a grinding image in the region of the bearing crest after tempering, in 100-fold enlargement.

Thereafter, the sealing strip is tempered in air for two hours at 950° C., is rapidly quenched in air to 450° C., and reheated for an hour at 630° C. FIG. 3 shows a grinding image corresponding to that of FIG. 2, but after the heat treatment. An increase in the formation of nodular-like graphite can be seen very clearly.

Experimental tests in rotary engines with trochoidal bearing surfaces of chromium and nickel dispersion layers indicated excellent bearing behavior of the sealing strip produced in this manner.

Piston rings of cast iron can be produced in the same way as just described for the sealing strips. Tests in reciprocating engines with cylinder sleeves made of normal cast iron also show improved bearing and wear resistance with respect to piston rings produced in this manner.

It will be understood that the above description of the present invention is susceptible to various modifications, changes and adaptations, and the same are intended to be comprehended within the meaning and range of equivalents of the appended claims.

What is claimed is:

1. In a friction stressed machine part of cast iron which machine part is a sealing strip for a rotary engine, said sealing strip having a ledeburitic-containing bearing surface, the improvement wherein 0.1 to 10 area percent of the ledeburitic-containing bearing surface is predominantly nodular-shaped graphite.

2. A method for producing a friction stressed machine part of cast iron with a ledeburitic-containing bearing surface, wherein 0,1 to 10 area percent of predominantly nodular-shaped graphite is present in the ledeburitic-containing bearing surface, comprising producing the machine part by casting a molten cast iron having a temperature of about 1500° to 1550° C. against a quenching plate to quench the molten cast iron to a temperature of about 700° C. in 10 to 15 seconds so that the machine part hardens in a mottled manner in the region of the bearing surface.

3. A method for producing a friction stressed machine part of cast iron with a ledeburitic-containing bearing surface, from a non-ledeburitic-containing bearing surface, wherein 0.1 to 10 area percent of predominantly nodular-shaped graphite is present in the ledeburitic-containing bearing surface comprising melting the non-ledeburitic bearing surface of the machine part to a temperature of about 1500° to 1550° C. and then quenching the melted bearing surface to a temperature of about 700° C. in 10 to 15 seconds so as to harden in a mottled manner and thereby produce a ledeburitic-containing bearing surface having nodular-shaped graphite.

4. Method as defined in claim 3, wherein the melting is performed by an electric arc, induction heating, laser beam, plasma beam, or electron beam.

5. Method as defined in claim 3, wherein the melting takes place in the presence on the bearing surface of at least one of the elements boron, zirconium, bismuth, tellurium, the lanthanides, magnesium, strontium, tin, antimony, aluminum and lead.

6. A method for producing a friction stressed machine part of cast iron with a ledeburitic-containing bearing surface, wherein 0.1 to 10 area percent of predominantly nodular-shaped graphite is present in ledeburitic-containing bearing surface, comprising producing the machine part by casting against a quenching plate so as to ledeburitically harden the machine part in the region of the bearing surface, and subjecting the bearing surface to a tempering treatment after hardening by heating the machine part for 15 minutes to two hours to a temperature above 700° C., thereafter quenching to below 500° C., and then reheating for 30 minutes to two hours to a temperature up to 700° C.

7. A method for producing a friction stressed machine part of cast iron with a ledeburitic-containing bearing surface, wherein 0.1 to 10 area percent of predominantly nodular-shaped graphite is present in the ledeburitic-containing bearing surface, comprising melting the bearing surface of the machine part, ledeburitically quenching the melted bearing surface, and then subjecting the machine part to a tempering treatment by heating the machine part for 15 minutes to two hours to a temperature above 700° C., thereafter quenching to below 500° C., and then reheating for 30 minutes to two hours to a temperature up to 700° C.

8. Method as defined in claim 7, wherein the melting is performed by an electric arc, induction heating, laser beam, plasma beam, or electron beam.

9. Method as defined in claim 7, wherein the melting takes place in the presence on the bearing surface of at least one of the elements boron, zirconium, bismuth, tellurium, the lanthanides, magnesium, strontium, tin, antimony, aluminum and lead.

10. Method as defined in claim 2, wherein the cast iron is alloyed or unalloyed cast iron with lamellar graphite.

11. Method as defined in claim 2, wherein the cast iron is alloyed or unalloyed cast iron with spherical graphite.

12. In a friction stressed machine part of cast iron, which machine part is a piston ring for an internal combustion engine, said piston ring having a ledeburitic-containing sliding surface, the improvement wherein the ledeburitic-containing sliding surface contains from 0.1 to 10 area percent of predominantly nodular-shaped graphite.

13. Method as defined in claim 6, wherein the heating is at a temperature of from 700° C. to 1025° C. and the quenching is to a temperature of between 400° C. and 500° C.

14. Method as defined in claim 7 wherein the heating is at a temperature of from 700° C. to 1025° C. and the quenching is to a temperature of between 400° C. and 500° C.

* * * * *